US005605319A

United States Patent [19]

Reiley

[11] Patent Number: 5,605,319

[45] Date of Patent: Feb. 25, 1997

[54] LUMBER-STRAIGHTENING DEVICE

[76] Inventor: R. Patrick Reiley, 3997 Rd. 6.5 NE., Moses Lake, Wash. 98837

[21] Appl. No.: 512,152

[22] Filed: Aug. 7, 1995

[51] Int. Cl.[6] ..... B66F 3/00

[52] U.S. Cl. ..... 254/17

[58] Field of Search ..... 254/11, 15, 16, 254/17

[56] References Cited

U.S. PATENT DOCUMENTS

| | | | |
|---|---|---|---|
| 77,610 | 5/1868 | Hall | 254/17 |
| 1,086,374 | 2/1914 | Kraemer | 254/16 |
| 5,269,494 | 12/1993 | Pittman et al. | 254/17 |

FOREIGN PATENT DOCUMENTS

| | | | |
|---|---|---|---|
| 5057 | 3/1904 | United Kingdom | 254/11 |
| 401775 | 11/1933 | United Kingdom | 254/17 |
| 932305 | 7/1963 | United Kingdom | 254/17 |

*Primary Examiner*—Robert C. Watson
*Attorney, Agent, or Firm*—Miller Nash Wiener Hager & Carlsen

[57] ABSTRACT

The invention disclosed and claimed here is a lumber-straightening device for manipulating a cross-wise structural member relative to an underlying support joist. It includes a base plate which is releasably mountable to the support beam by a pair of pegs which rest on opposite side surfaces of the support beam. A hand-operated cylindrical cam head is pivotably mounted to the base plate. The point of pivotable attachment is off-center relative to the center point of the cam head. This allows the cam head to push a sliding plate against the cross-wise member for bending it into a desired position relative to the support beam. The direction of travel of the sliding plate follows a line or axis defined by the pivot point of the cam head and a separate guide pine, spaced from such pivot point, that follows a groove in the sliding plate. This relationship converts rotational force to linear force.

4 Claims, 7 Drawing Sheets

LUMBER-STRAIGHTENING DEVICE

TECHNICAL FIELD

The present invention is a hand tool. More particularly, it relates to tools for manipulating pieces of lumber or similar members while they are being nailed or fastened together.

BACKGROUND INFORMATION

Many residential decks are constructed from two by four or two by six decking boards slatted cross-wise over transversely extending support joists. There is usually a small gap between each decking board in order to allow water to pass easily through the deck after it is constructed. In order to have an attractive appearance, it is necessary to nail the decking boards so that the gap between each one is straight and all of the gaps are parallel relative to each other.

Like all lumber, the lumber used to make a deck is not perfectly straight. Most lumber warps somewhat during milling and drying. Consequently, when a carpenter builds a deck, he or she must adjust each decking board as it is nailed along its length to spread underlying support joists. Depending on the warpage of the decking board, it is often very difficult to bend and hold it while simultaneously trying to nail it.

The present invention solves the above problem. Moreover, it is adapted to be used in other situations where it is necessary to bend, manipulate, or hold one structural member which is attached cross-wise to another. The features and construction of the invention are further explained below.

SUMMARY OF THE INVENTION

The invention disclosed in this document is a hand-held device that is particularly well-suited for constructing decks as well as for use in other construction situations. It is a cam-operated device having a base or mounting plate, a sliding plate, and a hand-operated cylindrical cam head.

In normal operation, the base plate is mounted to a support beam or joist and held in place by two parallel, spaced pegs which rest on opposite sides of the support beam. The cam head pivots about a pivot pin affixed mounted to the base plate at a point which is off-center relative to the center point of the cam head. The sliding plate is positioned between the cam head and base plate. It slides relative to both the base plate and cam head and also has a push plate or face plate portion which is in sliding contact with the outer circumferential surface of the cam head. In typical use, the face plate portion abuts against a warped or bent region of a cross-wise member.

As the cam head is rotated, its off-center relationship to the base plate causes it to drive the face plate portion of the sliding plate against the cross-wise member. This action straightens the warped region relative to the support beam or joist so that the cross-wise member can be attached to it in a uniformly spaced manner.

The above description summarizes the invention. The specific details as to how the invention is constructed and operates will become apparent upon review of the following description which is to be read in conjunction with the accompanying drawings.

BRIEF DESCRIPTION OF THE DRAWINGS

In the drawings, like reference numerals and letters refer to like parts throughout-the various views, and wherein.

BEST MODE FOR CARRYING OUT THE INVENTION

Figure 1:
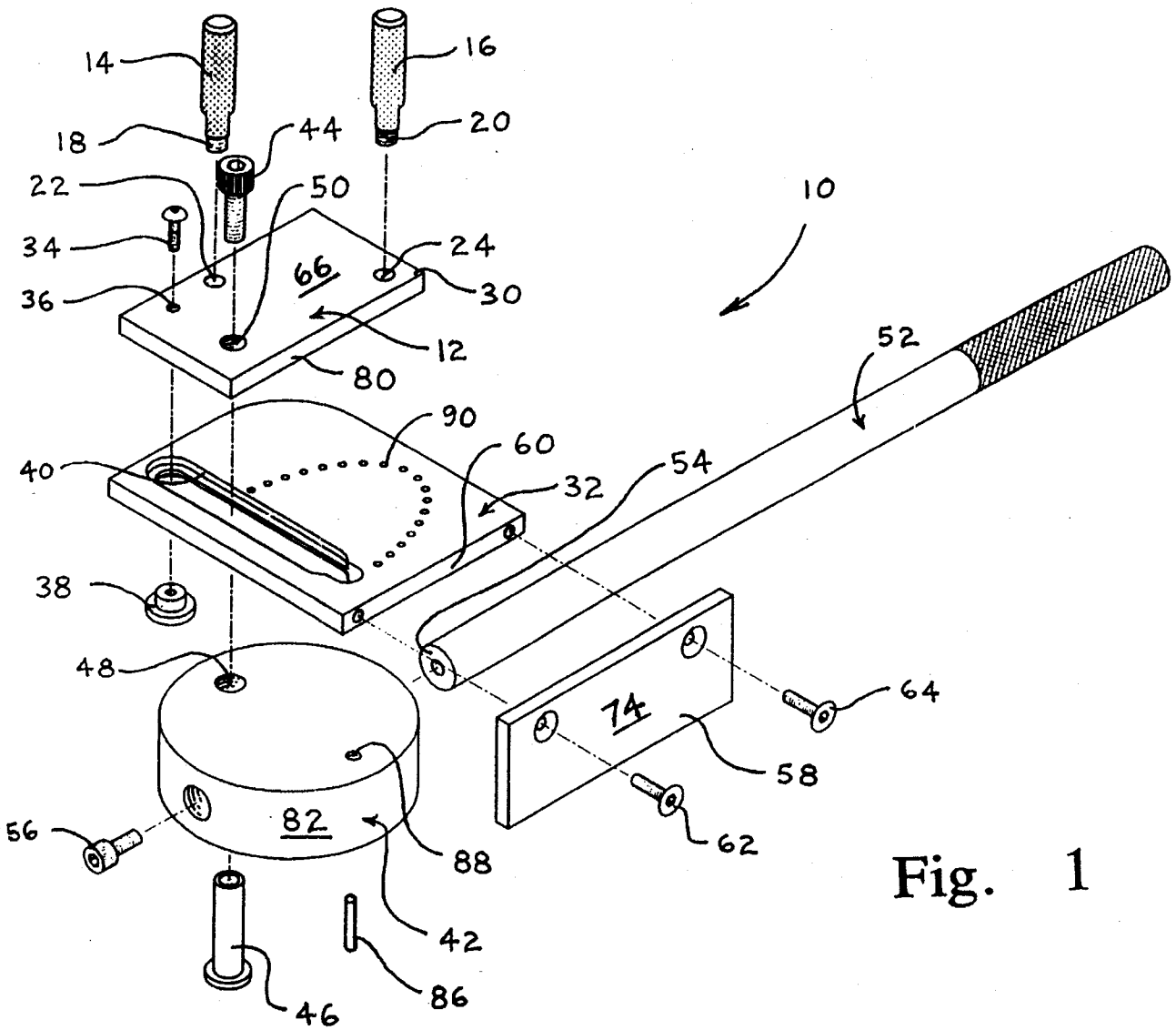
FIG. 1 is an exploded pictorial view of a lumber-straightening device constructed according to the invention.

Referring now to the drawings, and first to FIG. 1, shown generally at 10 is a lumber-straightening device ("device"). The device 10 as shown in FIG. 1 is exploded into its various parts in order to make it easy to ascertain how it is constructed.

The device 10 has a base plate 12 to which two pegs 14, 16 are mounted. Each peg 14, 16 has a threaded end 18, 20 which is screwed into corresponding threaded bores 22, 24 in the base plate 12.

Figure 11:
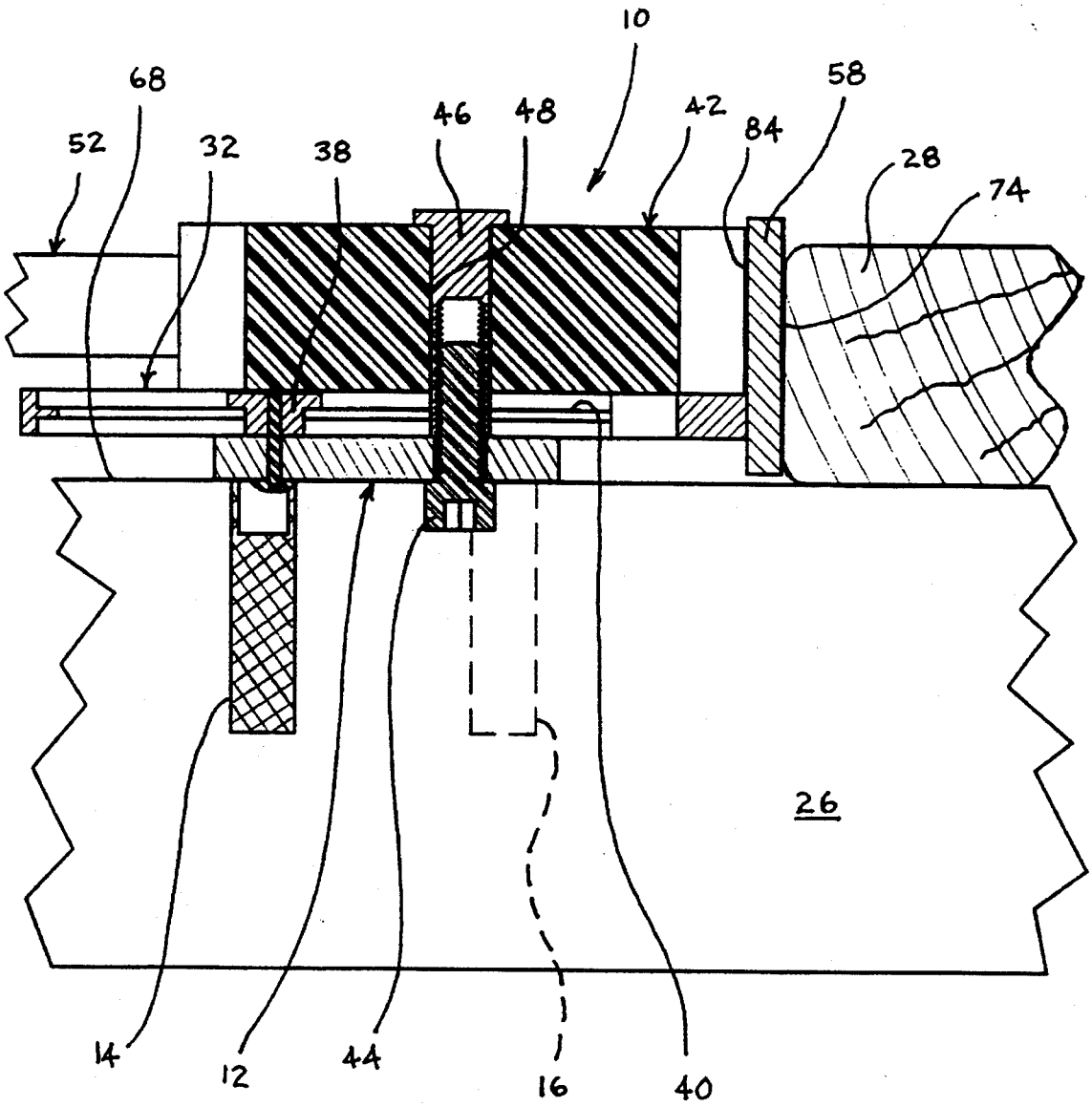
FIG. 11 is a side-cross-sectional view of the device.

The pegs 14, 16 have knurled surfaces for increasing the friction factor between them and the member (joist, post, etc.) to which the device 10 is mounted. This is clearly shown in FIG. 11, for example, where the device 10 is shown positioned on top of a support beam 26. Typically, the support 26 would either be a two by four, or two by six, or something similar, and support a plurality of cross-wise deck planks, a portion of which is shown at 28 (see FIG. 11) in partial cross-section.

The space between the pegs 14, 16 is varied depending on the construction application in which the device 10 is used. For most applications, the device 10 should be designed for solid stock joists used in residential deck construction such as a two by ten, for example. In such case, the pegs 14, 16, should have a 45 degree orientation relative to the corner of the rectangular base plate 12, such corner being indicated at 30 in FIG. 1.

Assuming that the bores 22, 24 in the base plate 12 define the ends of the hypotenuse of a right triangle, the length of the horizontal and vertical legs of the triangle should be approximately 1.5 inches (the length of the hypotenuse would be approximately 2.12 inches). For larger support beams, i.e., a four by four or four by six beam, the same distance should be 3.5 inches (hypotenuse length of 4.95 inches). It is nevertheless to be understood that the spacing between the knurled pegs 14, 16 could be any number of varying dimensions, depending on the type of member to which the device 10 is to be mounted.

Directing attention again to FIG. 1, a sliding cam plate 32, or sliding plate, is slidably mounted to the base plate 12. The cam plate 32 is mounted to the base plate 12 by means of a screw 34, which extends through a bore 36 in the base plate 12. The screw 34 is threaded into a guide pin 38. The guide pin 38 has a cylindrical head sized to fit for back and forth movement along a slot 40 in the sliding plate 32, as will be further described below.

Mounted to the sliding plate 32 is a pivotable cam head 42. The cam head 42 is cylindrical in shape and is connected to the base plate 12 by a hex head bolt 44 which is threaded into a sleeve-like pivot pin 46. The pivot pin 46 is received within a cylindrical bore 48 extending through the thickness of the head 42. The hex head bolt 44 extends through a bore 50 in the base plate 12, through the space defined by the open groove 40 in the cam plate 32, and threaded into the pivot pin 46. This arrangement (hereafter referred to as "pivot pin assembly 44, 46") enables the cam head 42 to pivot relative to the sliding plate 32.

Pivotable movement of the cam head 42 is controlled by an elongated cylindrical handle 52. The handle 52 is mounted to the cam head 42 by inserting an end 54 into a cylindrical socket which extends partially through the cam head 42. A screw 56 is threaded into the end 54 of the handle 52 in order to secure it into place. Obviously, there could be many other ways of mounting the handle 52 to the cam head 42.

A push plate or face plate 58 is connected to one side edge 60 of the sliding plate 62 by means of two screws 62, 64. The face plate 58 is perpendicular relative to the plane defined by the sliding plate 32.

Referring again to FIG. 11, in use, the device 10 is positioned on a first member so that the bottom surface 66 of the base plate 12 rests upon the upper side edge 68 of the member 26. The knurled pegs 14, 16 attached to the bottom of the base plate are positioned adjacent opposite sides 70, 72 of the member 26 (see FIGS. 5 and 6). The surface 74 of the face plate 58 abuts against a side edge 76 of a second member 78 that is located cross-wise or transversely relative to the first 26 (see FIGS. 3–6).

Figure 3:
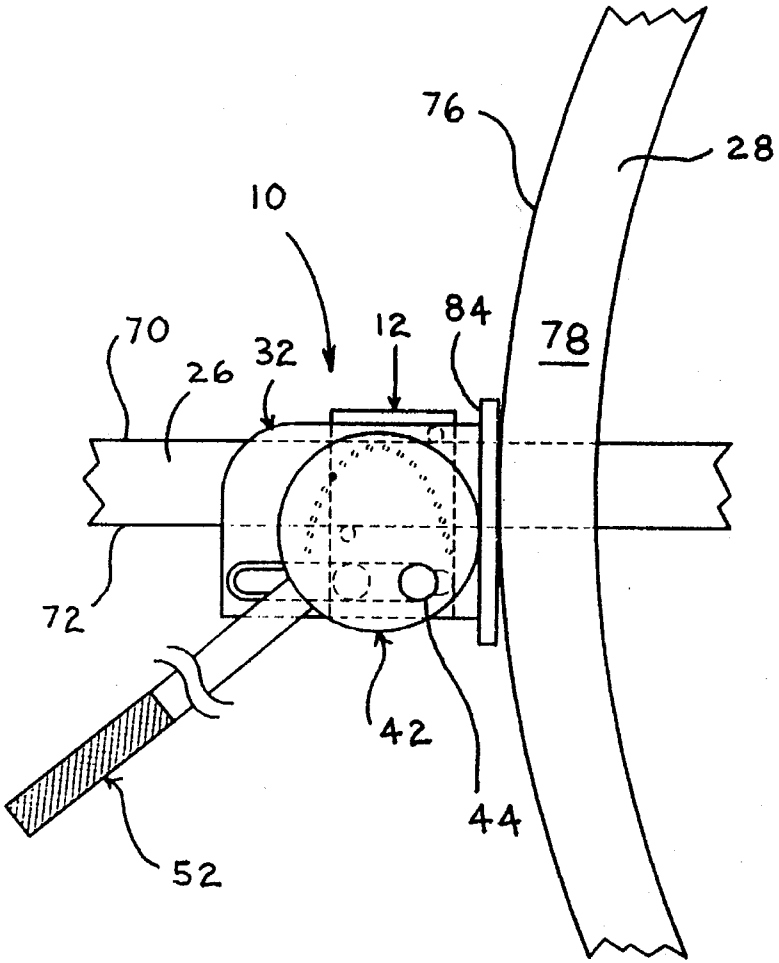
FIG. 3 is a top-plan view of the device shown in FIGS. 1 and 2 and shows it mounted to a support or joist for applying a force to a curved, cross-wise extending deck board.
Figure 5:
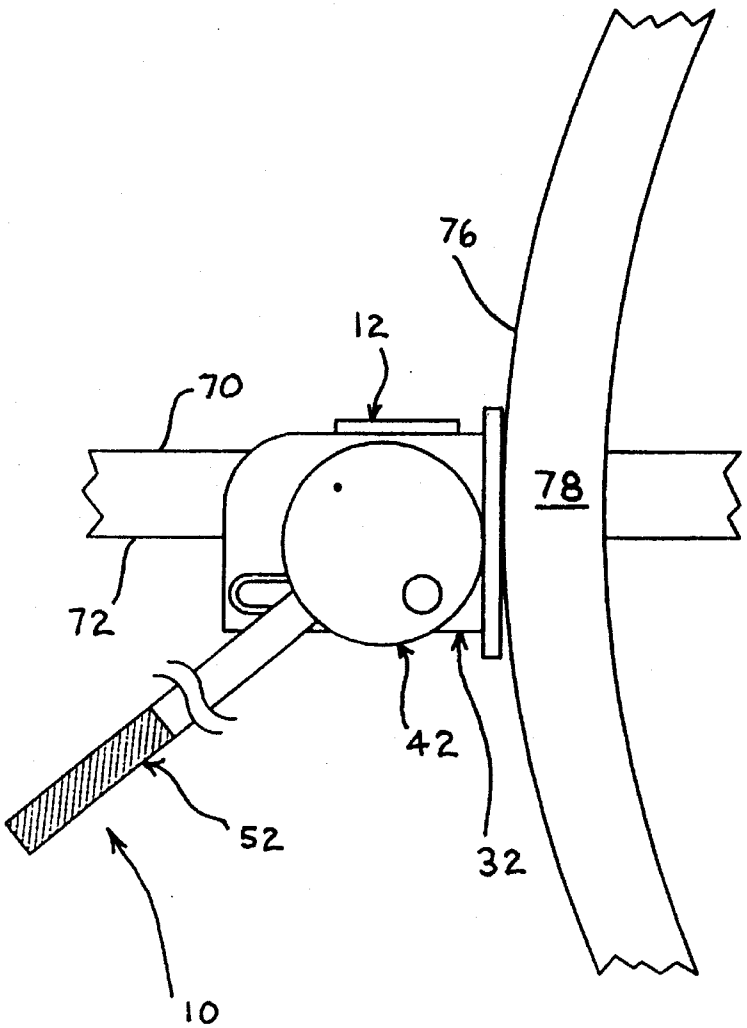
FIG. 5 is a top-plan view similar to FIG. 3.
Figure 8:
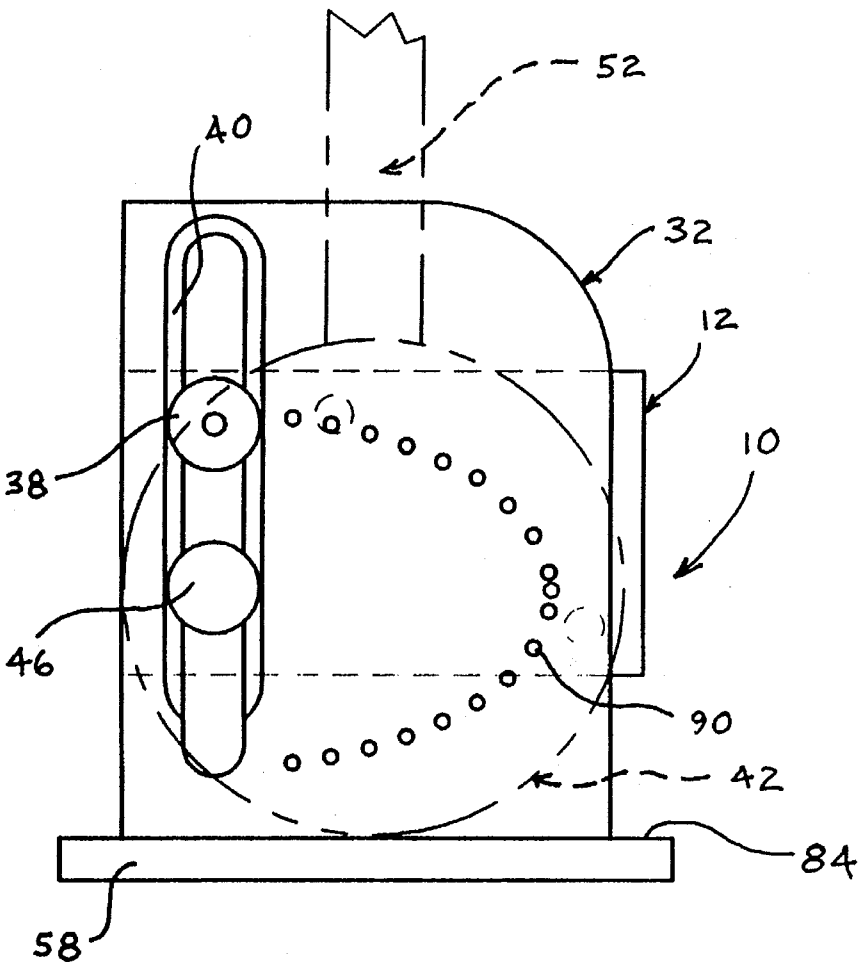
FIG. 8 is a top-plan view of a cam plate which makes up part of the head portion of the device.
Figure 7:
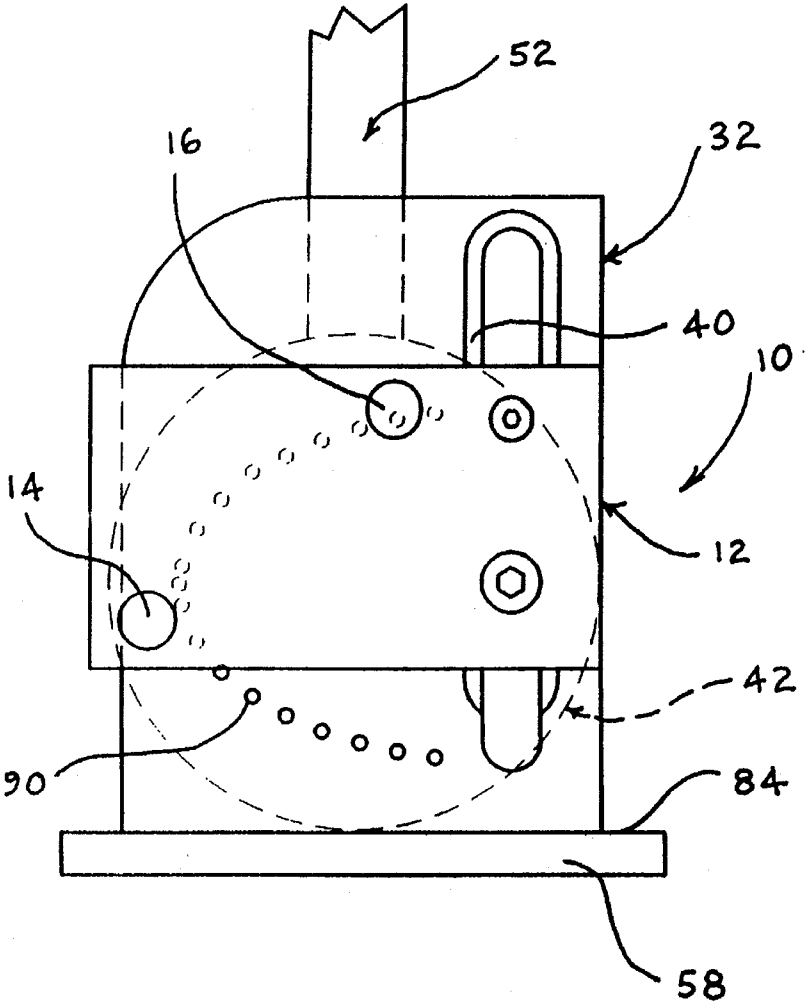
FIG. 7 is a bottom-plan view of the head portion of the device.
Figure 10:
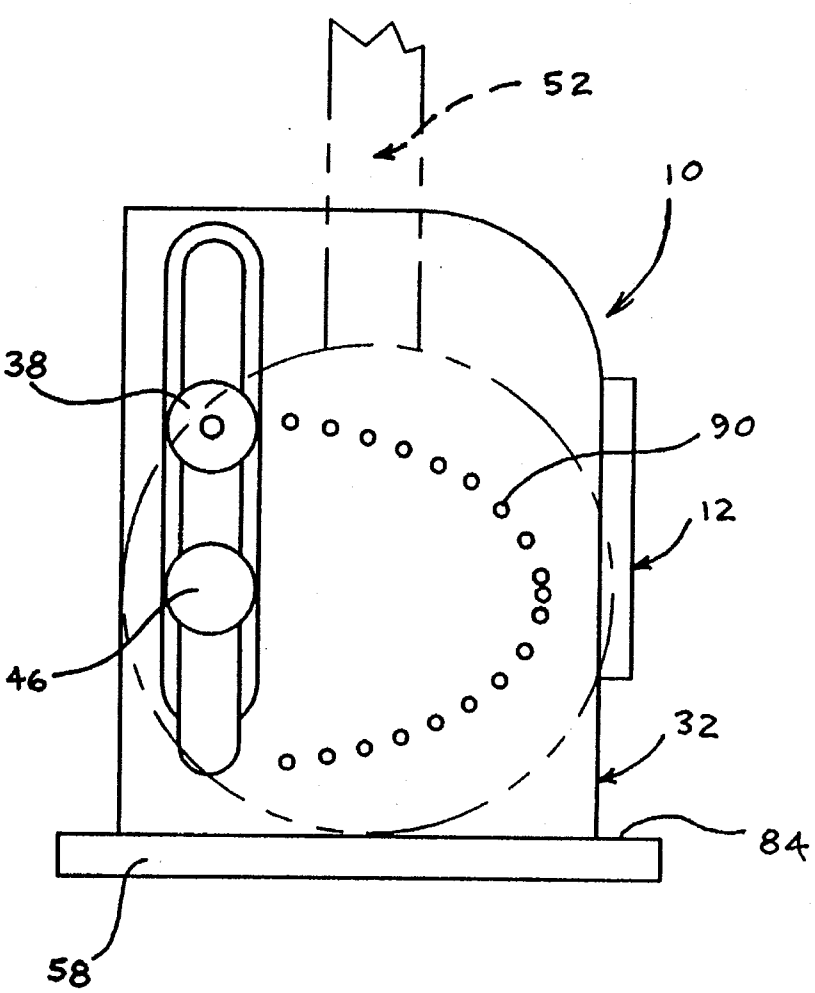
FIG. 10 is a view like FIG. 8.
Figure 9:
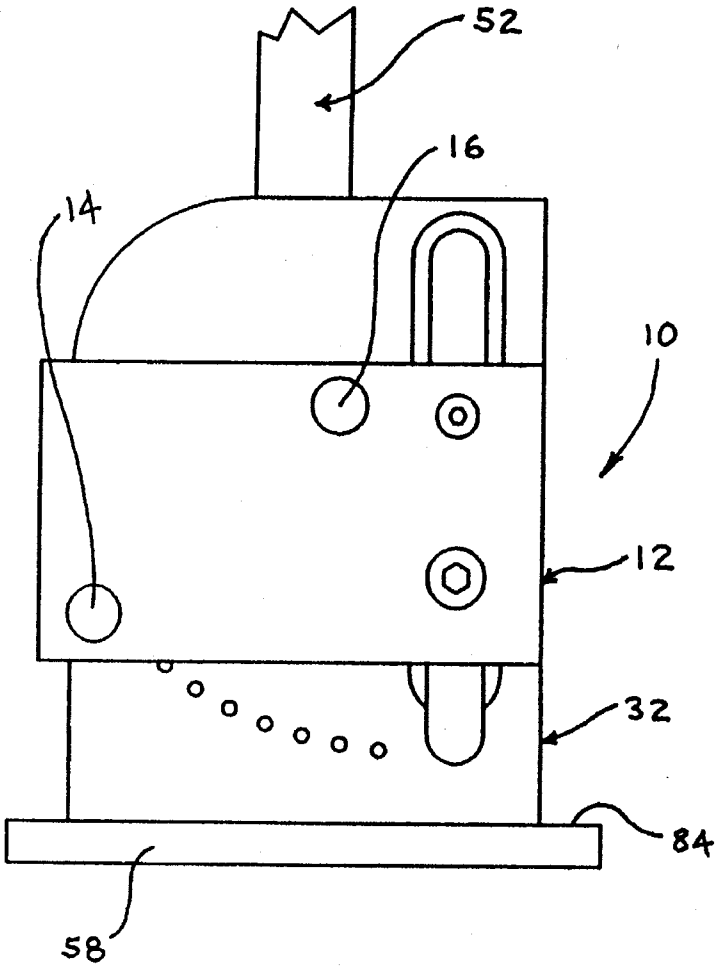
FIG. 9 is a bottom-plan view like FIG. 7.

FIGS. 3 and 5 show the second member 78 as being curved or bent, which would correspond to a warped piece of lumber such as a deck board, for example, or other structural member. Obviously, the curvature shown is exaggerated for the purpose of illustrating how the invention works.

As mentioned previously, the pivot pin assembly 44, 46, which pivotably mounts the cam head 42 to the base plate 12, is off-set or off-center relative to the center of the circle defined by the body of the cam head. When the device 10 is positioned for use against the second member 78, as shown in FIGS. 3 and 5, the cam head 42 should be rotated by the user by using the handle 52, so that the pivot point defined by the pin assembly 44, 46 is located as close as possible to the face plate 58. This involves simultaneously moving the sliding plate 32 aft relative to the base plate 12. The movement of the sliding plate 32 is guided by the guide pin 38 which slides along the groove 40 in the sliding plate 32. The pivot pin assembly 44, 46 which, as previously described, extends through groove 40, also guides the travel of the sliding plate 32.

Figure 4:
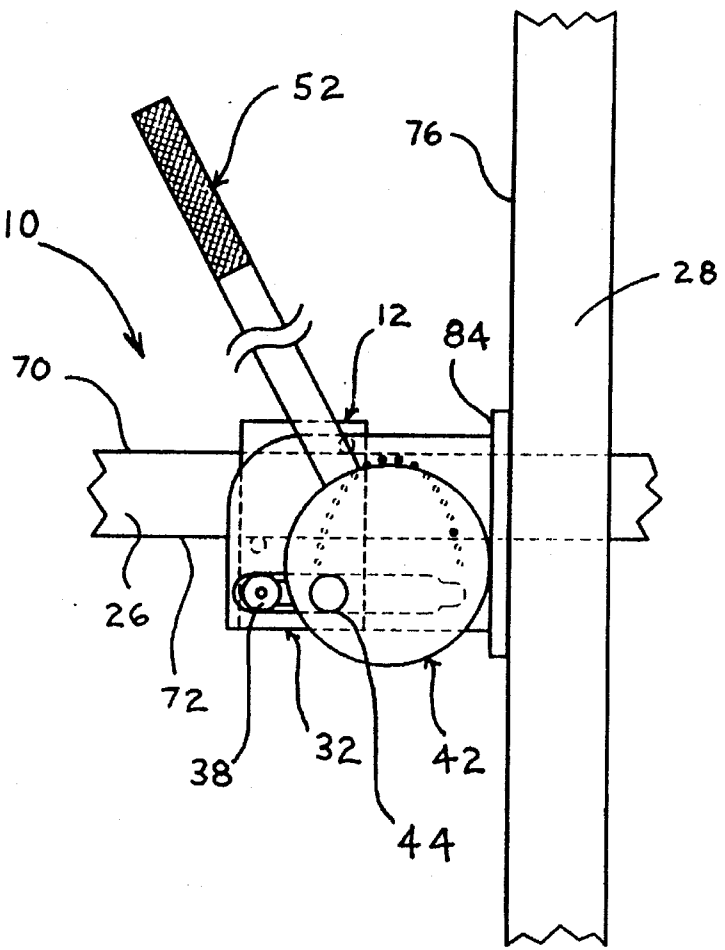
FIG. 4 is a view like FIG. 3 but shows the deck board after the device has been used to straighten it.
Figure 6:
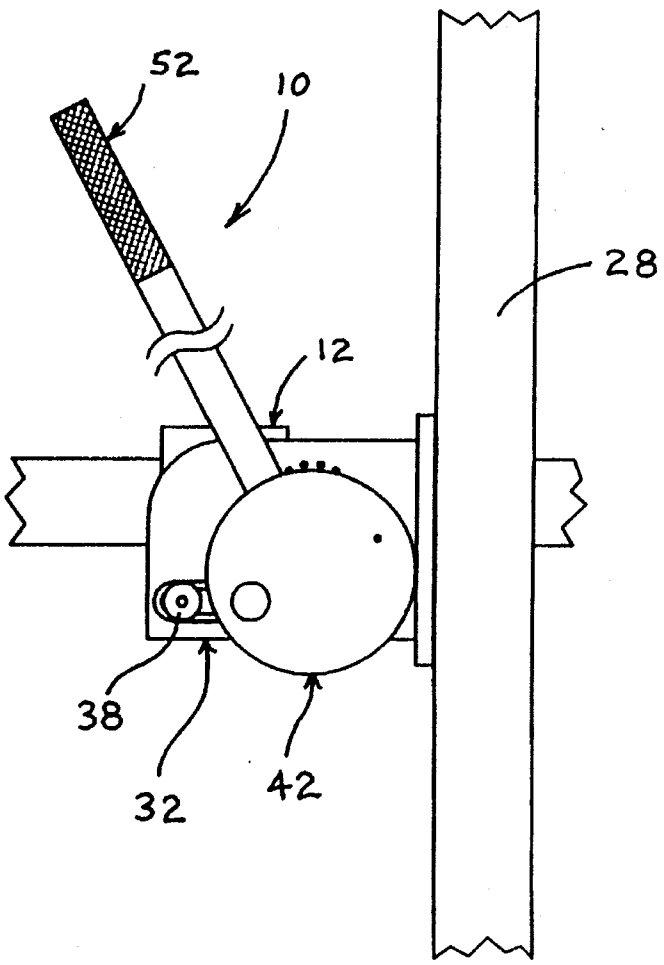
FIG. 6 is a top-plan view similar to FIG. 4.

After the device 10 is positioned as described above, the cam head 42 is rotated via handle 52 to the position shown in FIGS. 4 and 6. The moment force generated by this movement causes the pegs 14, 16 in base plate 12 to be torqued against the sides 70, 72 of the first member 26, thus fixing the device in position relative to the first member. This correspondingly fixes the position of the point (pivot pin assembly 44, 46) about which the cam head 42 rotates.

Figure 2:
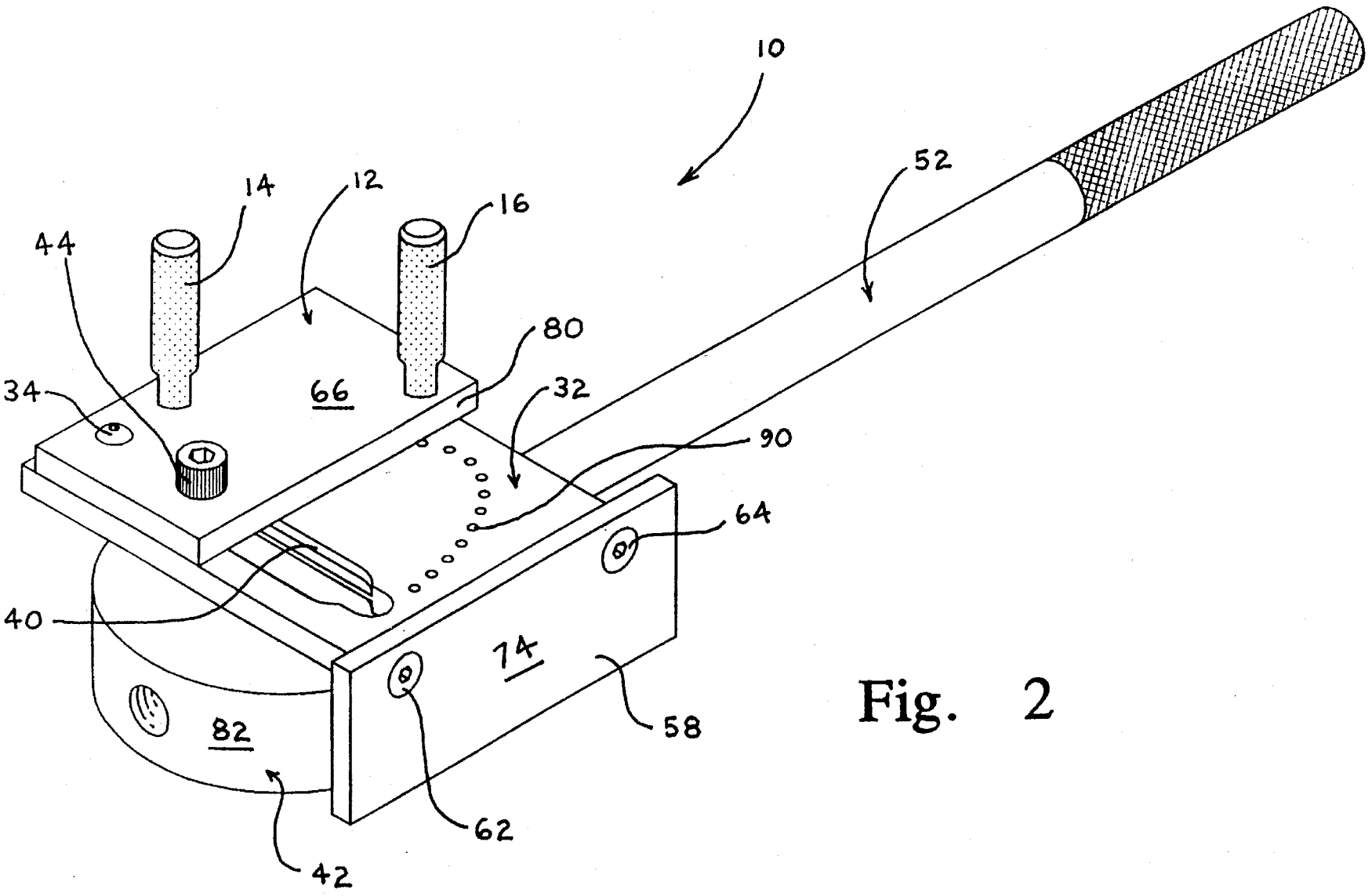
FIG. 2 is a pictorial view of the device shown in FIG. 1.

Rotation of the cam head 42, causes its outer surface 82 (see FIGS. 1 and 2) to push against the back side 84 of face plate 58, forcing it against the side edge 76 of the second member 78. At the same time, the sliding plate 32, and face plate 58, move relative to the base plate 12 and cam head 42, and push the bent or warped portion of the second member 78 into the straightened position shown in FIGS. 4 and 6.

The above operation can easily be performed by a single person. Once the device 10 has been used to straighten the second member as described above, it can be locked into place by a small, cylindrical lock pin 86. The lock pin 86 is extended through a cylindrical bore 88 in the cam head 42 so that an end of the pin engages with one of a plurality of openings 90 in the cam plate 32.

The openings 90 are arranged in an elliptical path corresponding to the path of travel of bore 88 as cam head 42 rotates. Having a large number of openings 90 allows the cam head 42 to be locked into the appropriate position depending on how far it must be turned in order to straighten the second member 78. Once locked, the moment forces generated in order to straighten the member 78 will hold the device in position by itself. Consequently, the user can remove his hands, leaving him or her free to nail or otherwise secure the second member 78 to the first 76.

The components of the device 10 can be made from a variety of materials. However, it has been found that Nylotron™ made by Polymer Corp. has excellent properties for use in making the cam head 42. The base plate 12 has been made from zinc-coated, cold-drawn steel. The cam plate 32 and push-plate 58 have been made from 6061T6 aluminum alloy. Last, the various pins and similar components have been made from cold-drawn steel.

The above description is not to be taken in a limiting sense. Although the device 10 was described above as being particularly useful for constructing decks, it has potential utility in other applications in residential or commercial construction, such as adjusting a cross-beam relative to a vertical joist or adjusting a post-and-beam assembly.

It is to be appreciated that changes could be made to the above design without departing from the spirit and scope of what is considered to be the invention. Consequently, what is considered to be the invention is limited solely by the subjoined claim or claims which follow, the interpretation of which is to be made in accordance with the established doctrines of patent claim interpretation.

What is claimed:

1. A device mountable to a first member for adjusting the position of a second member that is positioned generally cross-wise of the first, comprising:

a base part adapted to be releasably mounted to the first member;

a cylindrical cam head pivotably mounted to the base part in a manner defining a pivot point that is off-center relative to the center of the cam head;

a sliding part in sliding engagement with the base part and having a pushing portion adapted to push against at least a portion of the cross-wise member, wherein the sliding part is a rectangular plate having an elongated groove opening, and including a guide pin mounted to the base part, the guide pin having a portion shaped to track along the elongated groove opening, for guiding sliding movement of the sliding plate relative to the base part, and further, the pushing portion is slidingly drivable by the cam head toward the cross-wise member as the cam head rotates.

2. The device of claim 1, wherein the base part is a rectangular base plate, and including a pair of spaced pegs extending in parallel arrangement from a lower side of the base plate, and wherein, in use, the device is mountable to the first member by positioning the first member between the spaced apart pegs.

3. A device mountable to a first member for adjusting the position of a second member that is positioned generally cross-wise of the first, comprising:

a base part adapted to be releasably mounted to the first member;

a cylindrical cam head pivotably mounted to the base part in a manner defining a pivot point that is off-center relative to the center of the cam head;

a sliding part in sliding engagement with the base part and having a pushing portion adapted to push against at least a portion of the cross-wise member, wherein the pushing portion is slidingly drivable by the cam head toward the cross-wise member as the cam head rotates, and further;

the cam head has a lock-pin opening which is off-set relative to the pivot point, and still further, the sliding part has a plurality of openings which follow the path of movement of the lock-pin opening as the cam head rotates, for allowing a lock-pin having a portion received in the lock-pin opening to engage with any one of the openings in the sliding part.

4. A device mountable to a first elongated member for adjusting the position of a second member that is positioned generally cross-wise of the first, comprising:

a base part adapted to be releasably mounted to the first member;

a cylindrical cam head pivotably mounted to the base part in a manner defining a pivot point that is off-center relative to the center of the cam head, and further, the pivot point being laterally off-set from the first member;

a sliding part in sliding engagement with the base part and having a pushing portion adapted to push against at least a portion of the cross-wise member, wherein the pushing portion is slidingly drivable by the cam head toward the cross-wise member as the cam head rotates.

* * * * *